US007581319B1

(12) United States Patent
Little et al.

(10) Patent No.: US 7,581,319 B1
(45) Date of Patent: Sep. 1, 2009

(54) ELECTRIC TRIMMER WITH INTEGRATED BLADE SWITCHING MEANS

(76) Inventors: Robert J. Little, 3525 Sharonwood Rd., Laurel, MD (US) 27024; Alichanel Jones, 3525 Sharonwood Rd., Laurel, MD (US) 27024

( * ) Notice: Subject to any disclaimer, the term of this patent is extended or adjusted under 35 U.S.C. 154(b) by 284 days.

(21) Appl. No.: 11/821,643

(22) Filed: Jun. 25, 2007

(51) Int. Cl.
*B26B 19/02* (2006.01)

(52) U.S. Cl. ..... 30/43.92; 30/45; 30/535; 30/536; 30/210

(58) Field of Classification Search ..... 30/43.4, 30/43.5, 43.6, 43.7, 43.8, 43.9, 43.91, 43.92, 30/42, 43, 44, 45, 194, 195, 196, 197, 198, 30/199, 208, 209, 210, 215, 34.1, 201, 216, 30/124, 125, 535, 536; 132/123; 221/76, 221/79

See application file for complete search history.

(56) References Cited

U.S. PATENT DOCUMENTS

| | | | | | |
|---|---|---|---|---|---|
| 1,858,887 | A * | 5/1932 | Dremel | 30/216 |
| 2,224,342 | A * | 12/1940 | Forster | 30/41.6 |
| 2,388,324 | A * | 11/1945 | Holcomb | 30/41.5 |
| 2,723,452 | A * | 11/1955 | Jepson | 30/43.9 |
| 3,160,718 | A * | 12/1964 | Andis | 200/16 D |
| 3,997,967 | A * | 12/1976 | De Boer | 30/34.1 |
| 4,182,031 | A * | 1/1980 | Cecil, Jr. | 30/47 |
| 4,272,886 | A * | 6/1981 | Asano | 30/47 |
| 4,831,729 | A * | 5/1989 | Beuchat | 30/40.2 |
| 4,847,996 | A * | 7/1989 | Blykharov | 30/41.6 |
| 5,054,199 | A * | 10/1991 | Ogawa et al. | 30/34.1 |
| 5,461,782 | A * | 10/1995 | Rauch | 30/47 |
| D369,230 | S | 4/1996 | Bone | |
| 6,578,269 | B2 | 6/2003 | Wilcox et al. | |
| 6,665,938 | B2 | 12/2003 | McCambridge et al. | |
| 6,684,511 | B2 | 2/2004 | McCambridge et al. | |
| 6,968,623 | B2 | 11/2005 | Braun et al. | |
| 7,093,363 | B1 * | 8/2006 | Kuo | 30/47 |
| 2004/0083613 | A1 * | 5/2004 | Andis et al. | 30/34.05 |

FOREIGN PATENT DOCUMENTS

JP 03221086 A * 9/1991

* cited by examiner

*Primary Examiner*—Jason Daniel Prone
*Assistant Examiner*—Jennifer Swinney

(57) ABSTRACT

The invention is an improved electrical hair trimmer having an internal cleaning tray that cleans dirty cutting blades. Located adjacent to the cleaning tray is an internal conveying means that enables a dirty cutting blade to be removed and a cleaned cutting blade to be installed without the use of an external mechanism. The main benefit of this invention is to provide an electrical hair trimming tool that can automatically remove and clean a used and dirty cutting blade.

1 Claim, 2 Drawing Sheets

ELECTRIC TRIMMER WITH INTEGRATED BLADE SWITCHING MEANS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of electrical hair trimmers, more specifically, a hair trimmer with an integrated blade switching means.

B. Discussion of the Prior Art

The McCambridge et al. Patent (U.S. Pat. No. 6,656,938) discloses a hair trimming device having a slidably adjustable comb. However, the hair trimming device disclosed under the McCambridge Patent does not incorporate a cleaning tray with an internal conveyor in order to change the blades.

The Braun et al. Patent (U.S. Pat. No. 6,968,623) discloses a powered hair cutting device having an adjustable comb mechanism for changing the desired cutting length. However, the hair cutting device disclosed under the Braun Patent does not include a cleaning tray and conveyor in order to clean and change the cutting blade.

The McCambridge et al. Patent (U.S. Pat. No. 6,684,511) discloses a hair trimming device having one-hand control means and a rotatable blade set for alternating trimming lengths. However, the rotatable blade disclosed under the McCambridge Patent is not conveyed nor is it cleaned in a cleaning tray.

The Wilcox Patent (U.S. Pat. No. 6,758,269) discloses a hair trimmer having an adjustable comb control for setting trimming lengths. However, the hair trimmer disclosed under the Wilcox publication does not have an integrated cleaning tray and conveyor in order to rotate the trimming blades, clean the cutting blades that are not in use, and store all cleaning blades that are not in use.

The Andis et al. Patent Application Publication (U.S. Pub. No. 2004/0083613) discloses a rechargeable hair trimming device. However, the rechargeable hair trimming device disclosed under the Andis Publication does not include an integrated cleaning tray with an internal conveyor so as to clean, store, and rotate the cutting blades when not in use.

The Bone Patent (U.S. Pat. No. Des. 369,230) illustrates a design for a hair trimmer, which does not illustrate a cleaning tray with internal conveying means.

The Sculptor Cordless Trimmer disclosed under the 2003 Lambier catalog is a non-patent piece of prior art that discloses an electric hair trimmer with a cleaning brush and adjustable hair comb. However, the cordless trimmer does not include an internal cleaning tray with an internal conveyor for changing cutting blades, cleaning cutting blades, and storing cleaned cutting blades that are not in use.

In light of the above discussed prior art there is a need for an electrical hair trimmer having an internal cleaning tray and an internal conveyor so as to change out cutting blades internally, clean cutting blades, and store cleaned cutting blades.

BRIEF SUMMARY OF THE INVENTION

The invention is an improved electrical hair trimmer having an internal cleaning tray that cleans dirty cutting blades. Located adjacent to the cleaning tray is an internal conveying means that enables a dirty cutting blade to be removed and a cleaned cutting blade to be installed without the use of an external mechanism. The main benefit of this invention is to provide an electrical hair trimming tool that can automatically remove and clean a used and dirty cutting blade.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
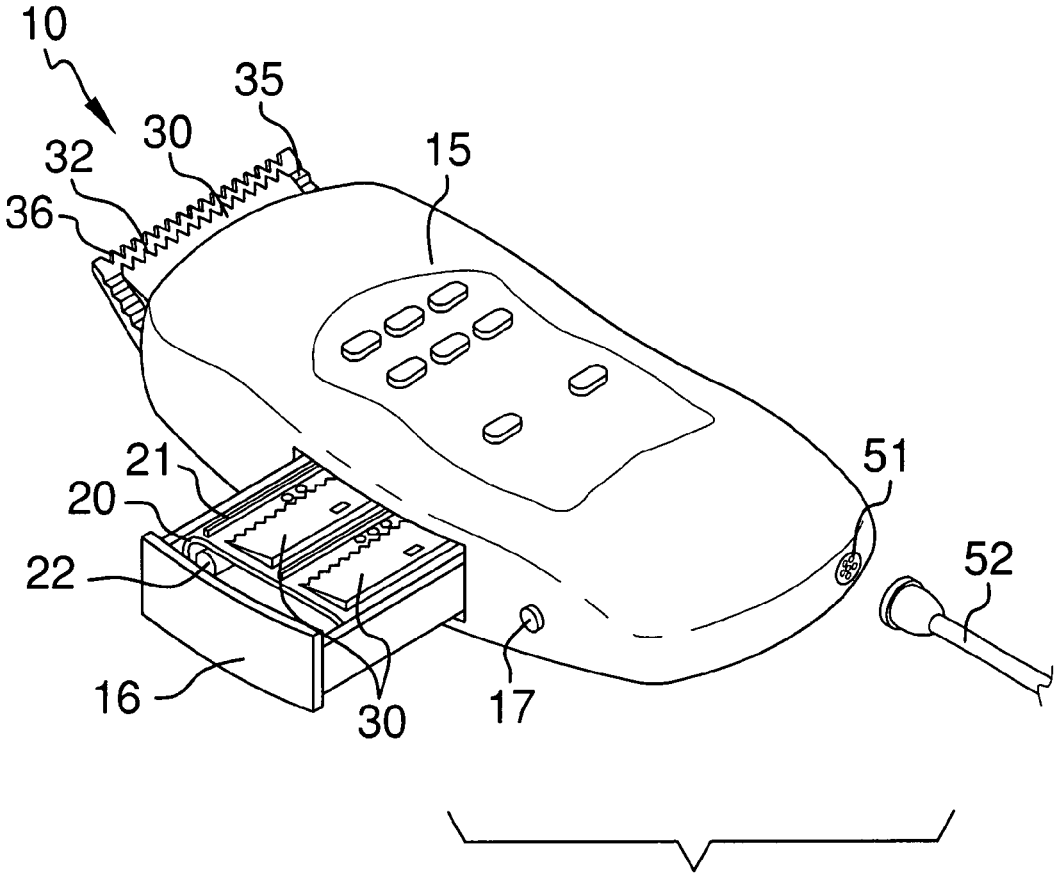
FIG. 1 illustrates an isometric rendering of the invention with the cleaning tray in an open position.

Detailed reference will now be made to the preferred embodiments of the present invention, examples of which are illustrated in FIGS. 1-5. An electrical hair trimmer 10 (hereinafter invention) includes housing 15, a cleaning tray 16 that extends from a side of the housing 10. Located adjacent to the housing 15 is a tray open button 17 that when depressed released the cleaning tray 16, which then extends to an open position, as illustrated in FIG. 1.

Located within the cleaning tray 16 is a conveyor belt 20 upon which a plurality of cutting blades 30 rest when not in use. Located on the conveyor belt 20 are a plurality of stops 21, which rotate along with the conveyor belt 20 and aid in the conveyance of the cutting blades 30. The conveyor belt 20 is rotated by a drive shaft 22, which is powered by a conveyor motor 23.

Located within the housing 15 and forward of the conveyor 20 is a track 24 upon which a transport 25 is slidably mounted thereon. The transport 25 can move either towards or away from the conveyor 20. Located on the transport are a pair of pulls 26, which engage and are aligned with mounting holes 31 located on the cutting blades 30.

The cutting blades 30 are conveyed forward from the conveyor 20 until a cutting blade 30 connects with the transport 25. Once the cutting blade 30 engages the transport 25 via the pulls 26 and the mounting holes 31, the transport 25 will move the cutting blade via the motor 23 toward the end of the housing 15 having the cutting blade back 35. The cutting blade back 35 is permanently mounted to the exterior of the housing 15 and has a serrated edge 36 along one end. The serrated edge 36 corresponds with a cutting blade serrated edge 32.

It shall be noted that with most electrical hair trimmers, the cutting blade 30 and cutting blade back 35 shear hair due to a lateral movement of the cutting blade 30 with respect to the cutting blade back 35. It shall be asserted that this lateral movement is accomplished with this invention via the transport 25.

Figure 4:
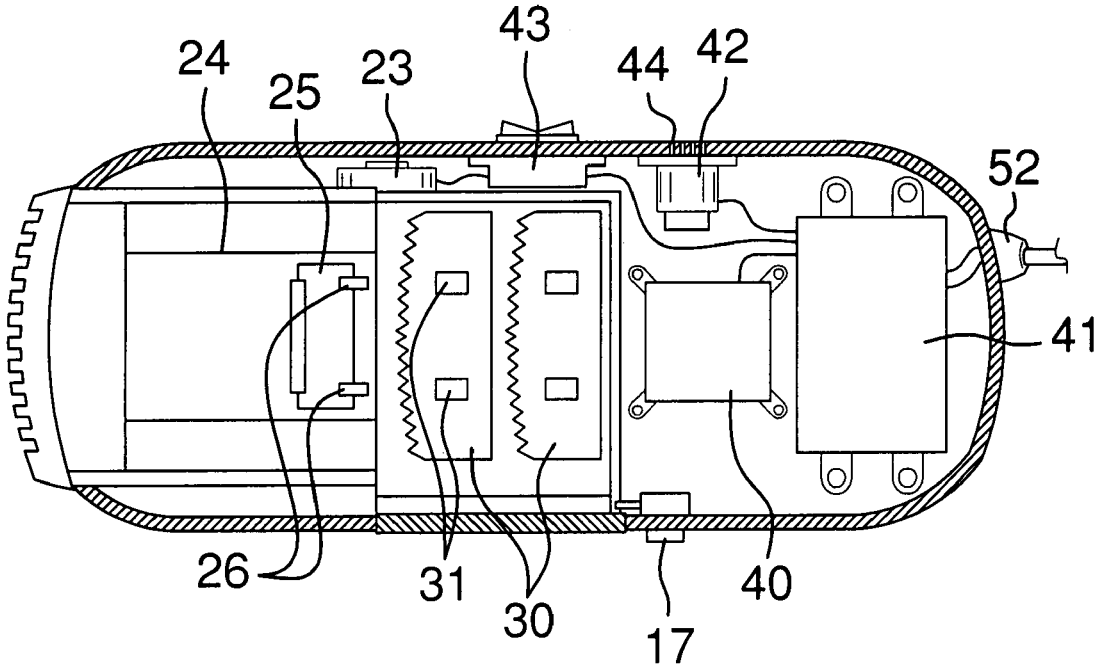
FIG. 4 illustrates a cross-sectional view of the internal components of the invention.

Located within the housing 15 are a control unit 40, a battery pack 41, a blower 42, and switch 43. The battery pack 41 is individually electrically wired to the control unit 40, the blower 42, and the switch 43. The switch 43 is also electrically wired to the motor 23. As depicted in FIG. 4, the battery pack 41 and control unit 40 are securely mounted to an interior surface of the housing 15.

An exhaust hole 44 is provided along a portion of the housing 15 and is designed to enable the blower 42 to blow heated air from within the housing 15 out to the surrounding air in order to lower the temperature immediately surrounding the electrical components contained within the housing 15.

Figure 2:
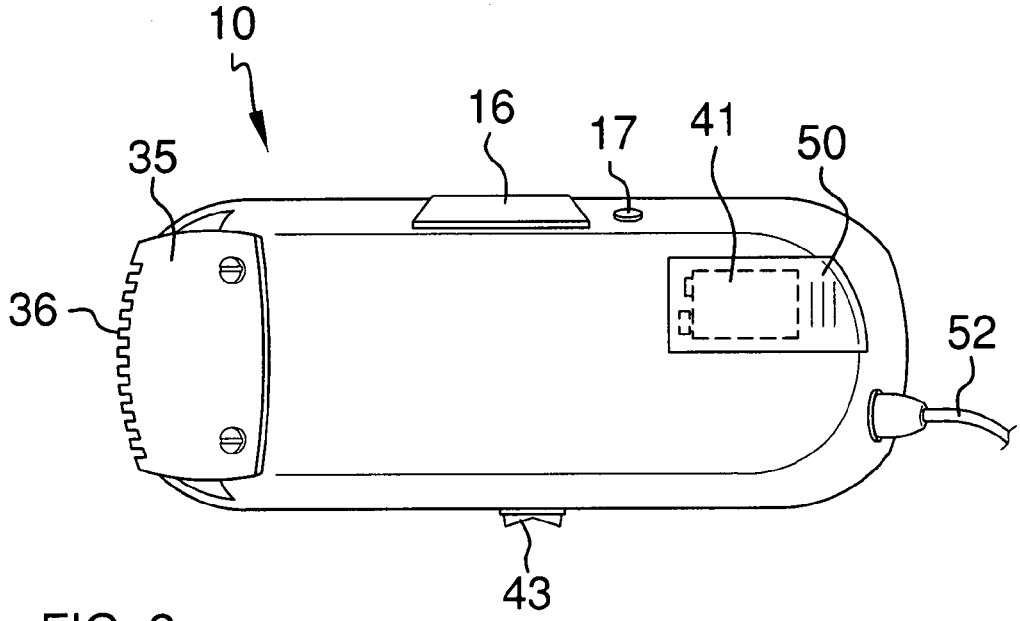
FIG. 2 illustrates a bottom view of the invention.
Figure 3:
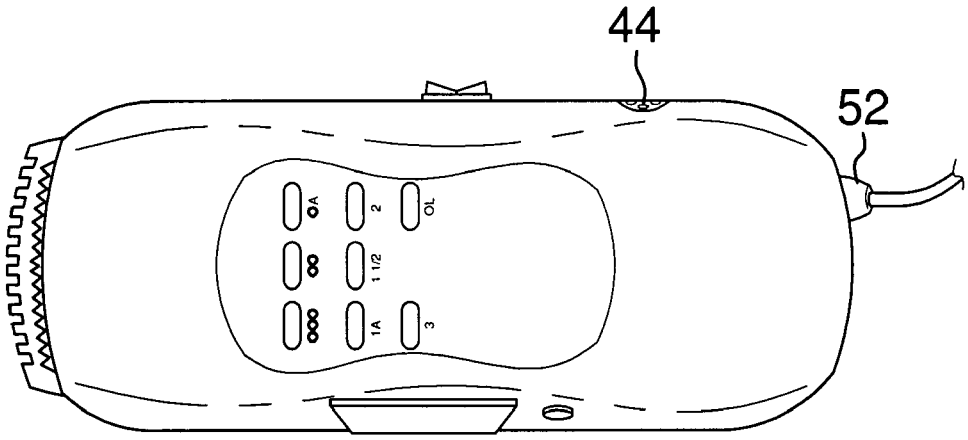
FIG. 3 illustrates a top view of the invention.

As depicted in FIG. 2, the battery pack 41 is enclosed in a portion of the housing 15 and is accessed by a slidably removable cover 50. The battery pack 41 is a consumable battery that can provide electricity. An alternative power source of the invention 10 uses a power cord 52 that attaches to a power cord port 51 located on the housing 15.

The blower 42 is designed to prevent the overheating of all of the electrical components located within the housing 15. It shall be noted that a portion of the interior of the housing 15 containing the cleaning tray 16, conveyor 20, track 24, and transport 25 are all separated from the remaining internal components of the invention 10. The above described portion of the interior of the housing 15 shall be designated for the cleaning, storing, and conveyancing of the cutting blades 30.

It shall be noted that the cleaning tray 16 shall form a watertight seal along the side of the housing 15 from where the cleaning tray 16 extends, so as to prevent any cleaning solution from exiting the invention 10 when the cleaning tray 16 is in a closed position.

Located on a front portion of the housing 15 is a plurality of buttons 60 that provide an end user with the necessary controls to operate the conveyor 20 and transport 25.

The invention claimed is:

1. An electrical hair trimmer comprising:

(a) a housing;

(b) a cleaning tray;

wherein the cleaning tray slides into and extends from a side of the housing;

wherein located adjacent to an opening on the housing for the cleaning tray is a release button that when depressed releases a lock securing the cleaning tray so as to enable the cleaning tray to extend out from the housing;

(c) a conveyor;

wherein a conveyor is attached to the interior of the cleaning tray;

wherein a plurality of stops are mounted to the conveyor and provide a means to move a cutting blade along with a movement of the conveyor;

(d) a motor;

(e) a drive shaft;

wherein the motor rotates the drive shaft;

wherein the drive shaft rotates the conveyor;

(f) a track;

wherein the track is located adjacent to the conveyor and inside of the housing;

(g) a transport;

wherein the transport is slidably attached to the track and is capable of moving back and forth with respect to the conveyor;

wherein the transport moves the cutting blade from the conveyor to the end of the housing where the cutting blade is aligned with a cutting blade back;

wherein the transport is propelled by the motor;

(h) an ON/OFF switch;

wherein the ON/OFF switch is electrically wired to the motor;

(i) a battery pack;

wherein the ON/OFF switch is electrically wired to the battery pack;

wherein the battery pack contains a consumable battery;

(j) a power cord port;

wherein the power cord port is located on the housing;

wherein a power cord may plug into the power cord port and provide electricity to the invention when the consumable battery is either not present or no longer charged;

(k) a control unit;

wherein the control unit is electrically wired to the battery pack;

wherein the control unit is electrically wired to the ON/OFF switch; and (l) a blower;

wherein the blower is electrically wired to the control unit.

* * * * *